United States Patent [19]

Hollon et al.

[11] Patent Number: 4,465,397

[45] Date of Patent: Aug. 14, 1984

[54] TRACK SURFACE LAYING

[76] Inventors: Edmund D. Hollon, 130 Frontier Ave., Douglas, Wyo. 82633; Blake D. Hollon, 831 Grant St., No. 3, Douglas, Wyo. 82633

[21] Appl. No.: 291,319

[22] Filed: Aug. 10, 1981

[51] Int. Cl.[3] ..... E01C 19/22

[52] U.S. Cl. ..... 404/84; 404/72; 404/120

[58] Field of Search ..... 404/84, 106, 108, 118, 404/119, 120, 72, 77, 79, 82, 95, 105

[56] References Cited

U.S. PATENT DOCUMENTS

| | | | |
|---|---|---|---|
| 1,930,309 | 10/1933 | Gallagher | 404/119 X |
| 1,966,122 | 7/1934 | Hurt | 404/108 |
| 2,094,910 | 10/1937 | Baily | 404/114 X |
| 2,185,645 | 1/1940 | Mosel | 404/120 |
| 2,303,335 | 12/1942 | Day | 404/114 X |
| 3,229,601 | 1/1966 | Philpott | 404/103 |
| 3,230,845 | 1/1966 | Mauldin | 404/110 |
| 3,396,642 | 8/1968 | Martinson | 404/118 X |
| 3,403,609 | 10/1968 | Bradshaw et al. | 404/118 X |
| 3,417,679 | 12/1968 | Crayton | 404/108 |
| 3,915,581 | 10/1975 | Copp, Jr. | 404/72 X |
| 4,197,032 | 4/1980 | Miller | 404/105 X |

*Primary Examiner*—James A. Leppink
*Assistant Examiner*—Beverly E. Hjorth
*Attorney, Agent, or Firm*—Hugh H. Drake

[57] ABSTRACT

To lay a running track, a resilient particulate material is spread over a substrate of a given width. Pressure is applied individually downwardly on the material over a plurality of respective segments of the width, as the material is smeared over and amongst the segments to form a bonded layer of said material which exhibits a continuous and even upper surface across said width. This is accomplished by means of a machine that includes an elongated frame of a length sufficient to span a plurality of lanes of a running track. A plurality of successively-hinged individually-articulatable platens depend from and are distributed along the frame. Each platen has a length corresponding generally to the width of respective ones of the lanes. Means included with respect to each of the platens enables the application of pressure on the material toward the underlying substrate of the track. Also included are means for reciprocating the platens laterally and generally across and between the respective ones of the lanes as well as means for moving the machine along the track.

23 Claims, 7 Drawing Figures

TRACK SURFACE LAYING

The present invention pertains to track surface laying. More particularly, it relates to methods of laying a running track surface and to machines for accomplishing the same.

Competition in running events often involves racing by individuals over a prescribed surface. A typical running track is of oval configuration and of sufficient width to accommodate the competition among a plurality of individual competitors. As the sport developed, it was found desirable to provide an all-weather surface on the track. At least in many cases, this was accomplished by applying a paving material, using the same techniques familiar in connection with the surfacing of highways for vehicles.

In time, of course, it was recognized that the approaches best suited for the building of highways for vehicles were not necessarily those applicable to running tracks. In the case of highways, attention was directed significantly toward wearing qualities when subjected to wheels that carried many tons of weight and involved the sideward pressures developed by turning movements. Surfaces developed to accommodate those purposes tended to be rather stiff or excessively hard. Nevertheless, that approach has been used in the laying of many running tracks throughout the country.

More recently, particular attention has been directed to the development of different compositions for the "paving" of running tracks. It has been recognized to be desirable to provide a track surface that exhibits a degree of resilience which serves better to cushion the jolt opposed against the feet, ankles and legs of the runner. At the same time, it was discovered that such resilience could result in an increased degree of excellence of performance. Indeed, competition developed as between different manufacturers of materials for the running track surfaces.

Notwithstanding such improvements in the materials concerned, problems remain in applying those materials to the underlying substrate. As the art progressed, a few manufacturers offered equipment which improved the surface laying operation by using heat as the material was pressed into place.

One difficulty with such improved approaches was that successive laterally-displaced lanes were implaced one at a time. With typical materials, there was insufficient bonding from one lane to the next unless the second lane was applied within a rather short period of time following the installation of the first lane. Often, additional effort had to be expended in creating a suitable seal between such a first lane and the next.

Another problem with the prior approaches was that different lanes exhibited different levels or slopes. That often resulted from uneven underlying substrate portions or differences in machine operation from one lane to the next. Any ridge between adjacent lanes was highly undesirable.

It is, accordingly, a general object of the present invention to provide an approach that overcomes deficiencies and disadvantages in prior approaches such as those adverted to above.

A particular object of the present invention is to provide a new and improved method of laying a running track that achieves a continuous and even upper surface across the width of the totality of the track.

A related object of the present invention is to provide a new and improved track laying machine.

A corresponding objective is that of enabling the laying of a high-quality running track with efficiency and economy.

To lay a running track in accordance with the present approach, a resilient particulate material is spread over a substrate of a given width. Pressure is applied individually downwardly on that material over a plurality of respective segments of the width. The material is smeared over and amongst the segments to form a bonded layer of the material which exhibits a continuous and even upper surface across the width.

A machine for such a purpose includes an elongated frame of a length sufficient to span a plurality of lanes of the running track. A plurality of successively-hinged individually-articulatable platens depend from and are distributed along the frame. Each platen has a length generally corresponding to the width of a respective one of the lanes. Means included with respect to each of the platens enables the application of pressure on the material toward the underlying substrate of the track. Also included are means for reciprocating the platens laterally across and between the respective ones of the lanes and means for moving the machine along the track.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
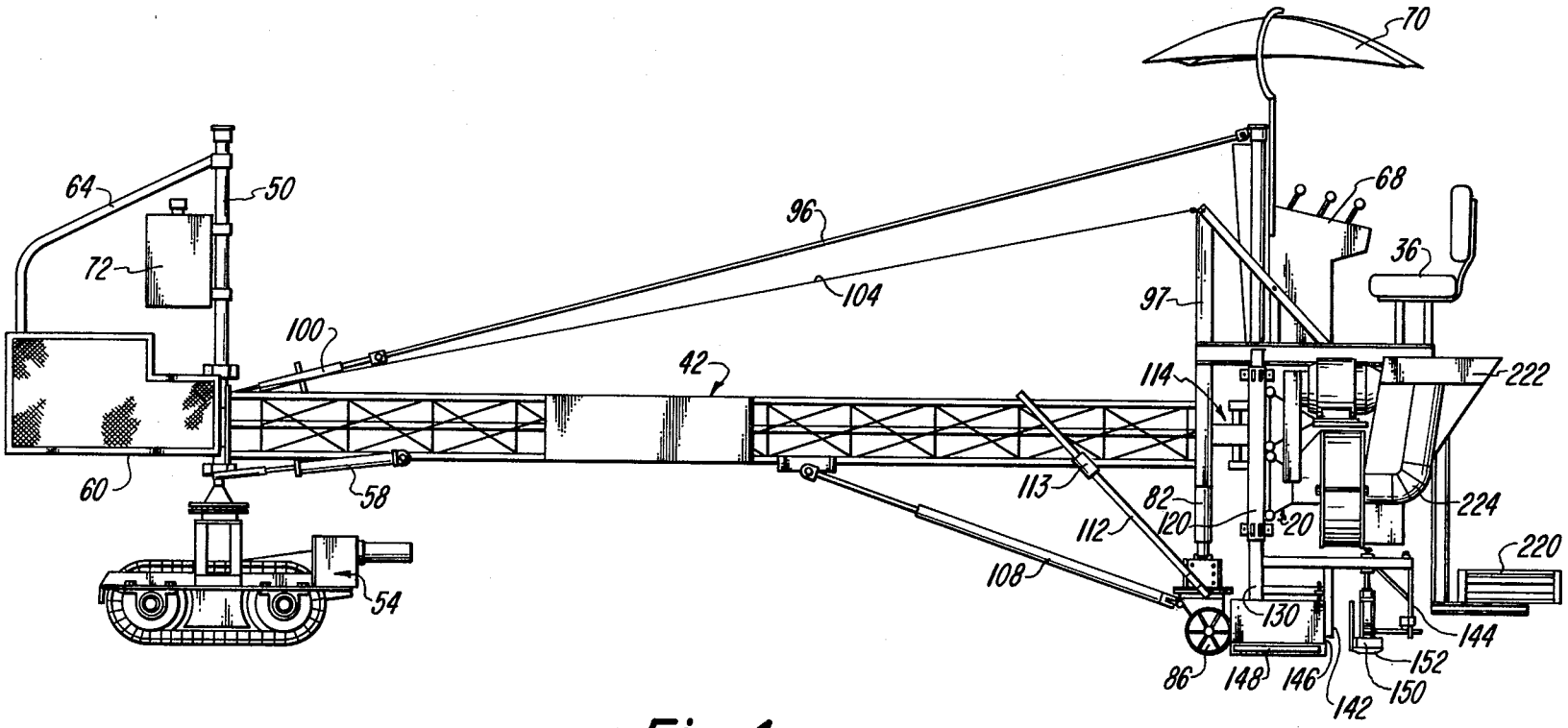
FIG. 1 is a side elevational view of a track laying machine.
Figure 2:
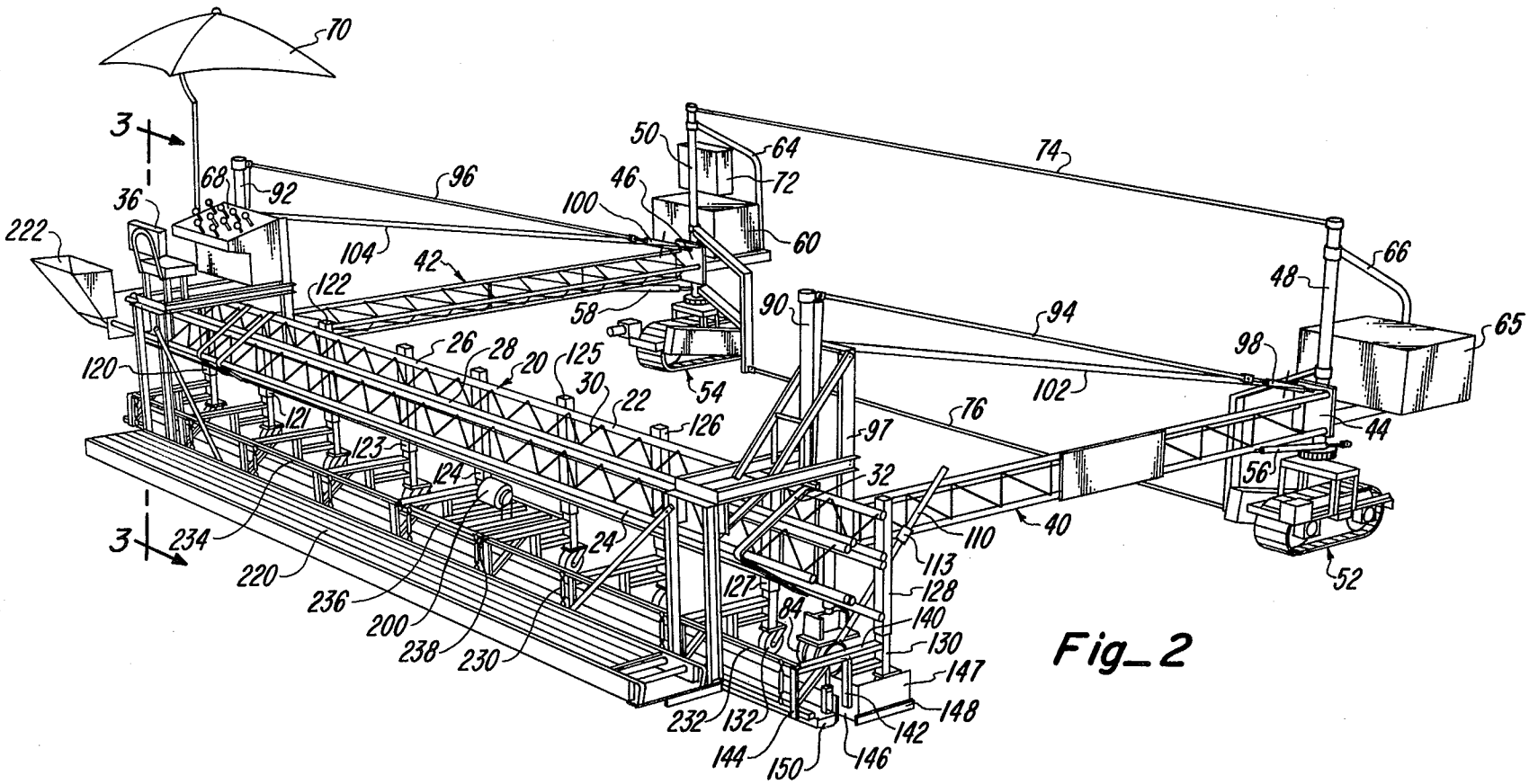
FIG. 2 is a perspective view thereof.
Figure 3:
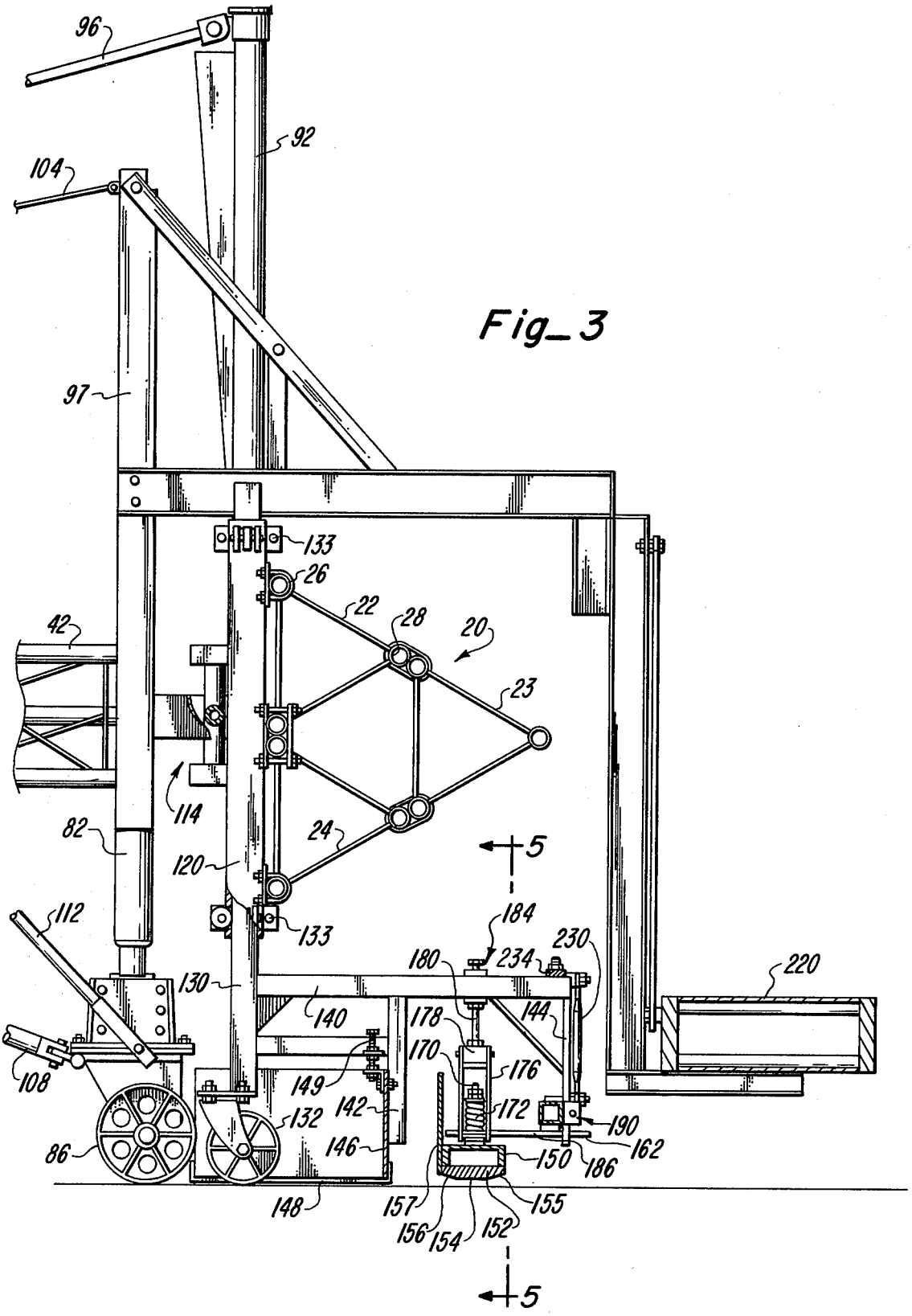
FIG. 3 is an enlarged fragmentary cross sectional view taken along the line 3—3 in FIG. 2.
Figure 4:
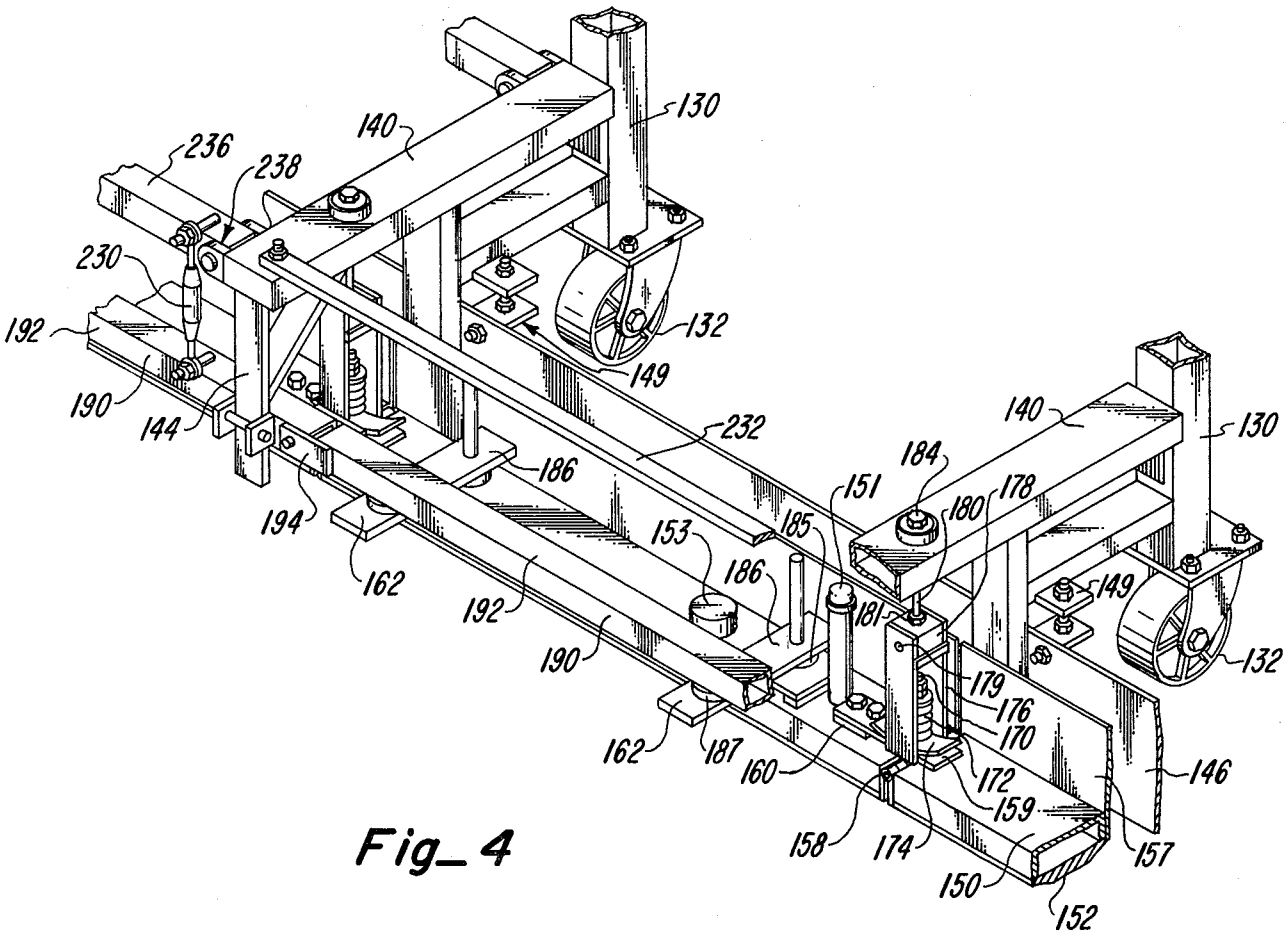
FIG. 4 is an enlarged fragmentary isometric view of components associated in the manner shown in FIGS. 3, 5 and 6.
Figure 5:
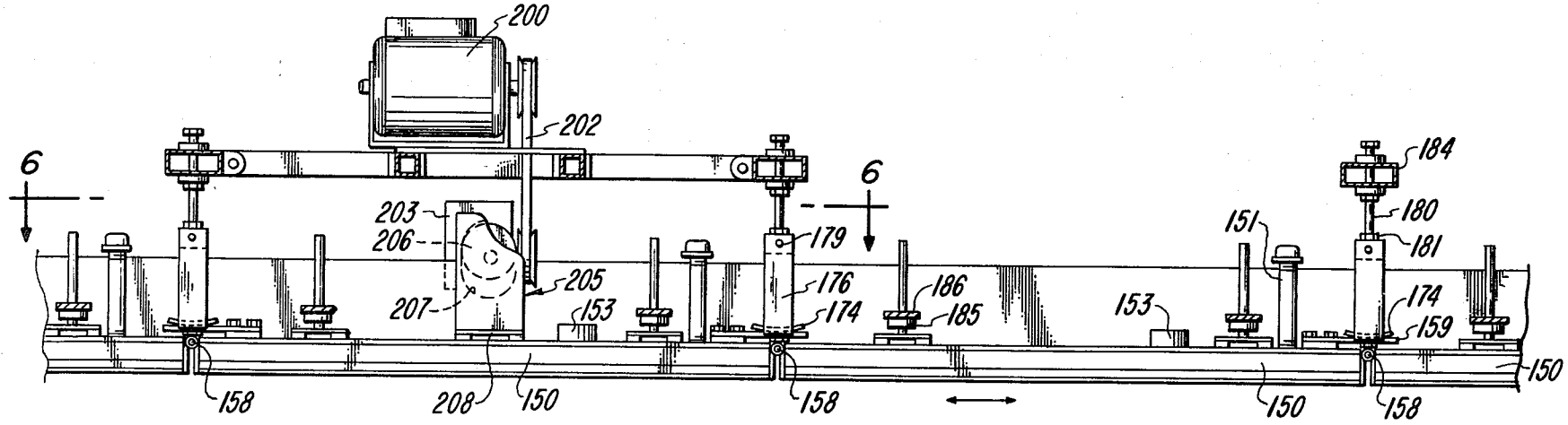
FIG. 5 is a fragmentary cross sectional view taken along the line 5—5 in FIG. 2.
Figure 6:
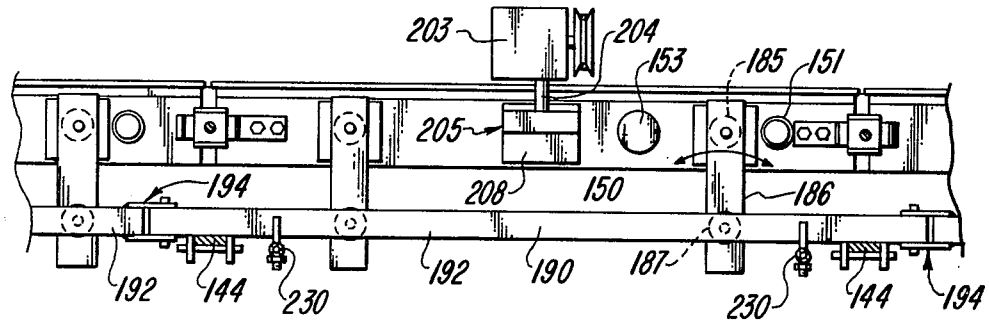
FIG. 6 is a fragmentary cross sectional view taken along the line 6—6 in FIG. 5.
Figure 7:
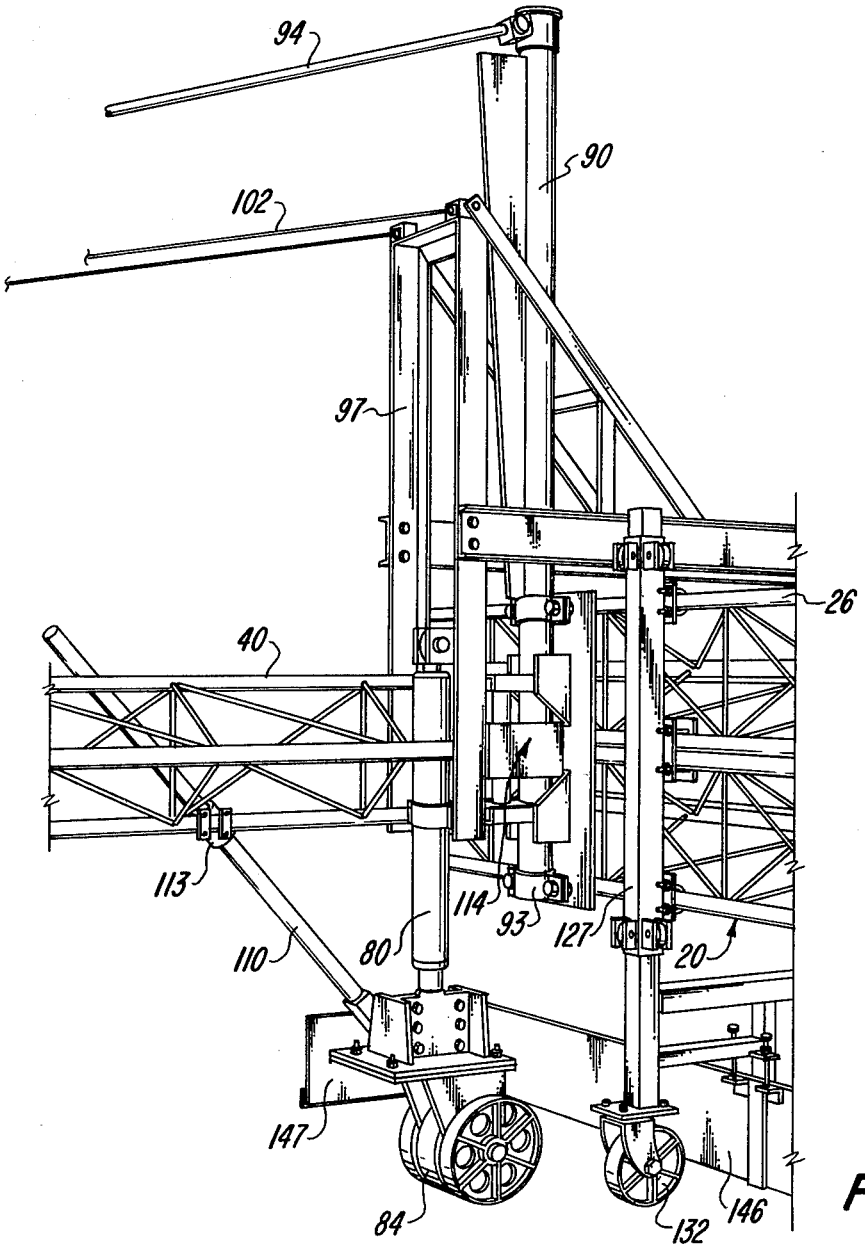
FIG. 7 is a fragmentary enlarged isometric view showing principal components of one portion of the machine as seen from within and at the lower portion of FIG. 2, certain components having been omitted from view for clarity.

An elongated frame or truss 20 is of a length sufficient to span a plurality of lanes of a running track. Typically in accordance with current rules, each such lane is defined to have a width of forty-two (42) inches. As illustrated, the machine is sufficient to span a total of eight such lanes.

The manner of constructing frame 20 may vary widely. As shown, it is convenient to utilize available latticeworks 22–24 each of which includes opposingly-spaced lengths of pipe as at 26 and 28 joined by a webbing of struts 30 to form a truss. Those assemblies are secured together and reinforced by straps as indicated at 32. Besides the convenience in the fact that such latticework assemblies and tubing are readily available, it may be noted that the use of a lattice arrangement allows an operator, situated upon a seat 36, to see through frame 20 for reasons that will become apparent.

Projecting forwardly from near each end of frame 20 are respective booms 40 and 42. For convenience and as illustrated, each of booms 40 and 42 are also constructed of tubes separated by a series of lattice-forming struts as shown. Each end of booms 40 and 42 is coupled respectively at 44 and 46 to a vertically-oriented one of corresponding spindles 48 and 50.

At its lower end, each spindle 48 and 50 terminates in a track assembly or crawler 52 and 54, respectively. Each of those track assemblies is powered for effecting movement of the entire machine and other ram movements by means of a coupled hydraulic motor at 60. In addition, each track assembly is rotatable about the axis of its associated one of spindles 48 and 50 by means of rams 56 and 58. A conventional engine and pump, disposed in the cabinet at 60 secured by bracket 64 on spindle 50, develops the hydraulic actuating power necessary to actuate the rams and motors already described as well as others yet to be mentioned. Another engine in a cabinet 65 drives a generator for supplying electrical power used by a motor and heaters yet to be described. A bracket 66 supports cabinet 65 on spindle 48.

Through conventional hydraulic piping, all mechanical actuations are under the control of levers situated on a control panel 68 disposed in front of the operator situated on seat 36. Above that control panel and the operator is an umbrella 70. A reservoir 72 of hydraulic fluid is conveniently hung from spindle 50. The ends of booms 40 and 42 remote from frame 20 also are fixed together by an upper tie cable 74 and a lower tie rod 76. Accordingly, a rectangular orientation is established with respect to a horizontal plane.

Secured off the rear of booms 40 and 42 are ram-adjustable telescoping pedestals 80 and 82. The rams in pedestals 80 and 82 are convenient and desired. However, they may be eliminated. Mounted at the bottom of each of pedestals 80 and 82 are respective carriage wheels 84 and 86. Wheels 84 and 86 serve, for one purpose, to enable the propulsion of frame 20 under the drive provided by assemblies 52 and 54 through booms 40 and 42. Rigidly secured to and projecting upwardly from the structure associated with frame 20 are posts 90 and 92 at respective opposite ends of the frame. Corresponding ties 94 and 96 extend from the top of those posts through turnbuckles at 98 and 100 to the ends at 44 and 46 of booms 40 and 42. Relatedly extending from the upper ends of associated stems 97 back to that same location at the remote ends of booms 40 and 42 are corresponding cables 102 and 104.

Extending upwardly from the bottom of pedestal 82 near wheel 86 is a ram 108. While crawlers 52 and 54 are the primary steering means, adjustment of ram 108 affords a finer control of the lateral position of frame 20, so that it can be held on line. Also extending upwardly from the bottom of each of pedestals 80 and 82 and into connection with respective ones of booms 40 and 42 are guides 110 and 112. The upper end portions of each of guides 110 and 112 are slidable within collars 113 affixed to the respective ones of booms 40 and 42. Those guides assist in maintaining a rectangular orientation of the overall machine.

The combination of pedestals 80 and 82, ties 94 and 96, turnbuckles 98 and 100, and booms 40 and 42 serves to enable precise adjustment of the vertical orientation of posts 90 and 92 and thus of the angular orientation about horizontal axes of frame 20 and other components associated therewith. Moreover, a triangular rigidification is achieved.

Between each of the rear ends of booms 40 and 42 and frame 20 are universal joints 114. In this case, each is secured near the bottom of respective ones of posts 90 and 92. Each has spindles which define both horizontal and vertical pivoting of the associated ends of booms 40 and 42. Joints 114 enable adjustment of the orientation of posts 90 and 92 free of any restraint imposed by booms 40 and 42.

Spaced laterally along the length of frame 20 and secured thereto are a plurality of downwardly-depending tubes 120–128. Each of these tubes includes an internally telescopic sleeve 130 on the lower end of which is mounted a feeler or sensing wheel 132. Each of the tubes includes bearings 133 that allow the associated sleeve 130 to freely float, vertically, within its tube.

Cantilevered to the rear from each of sleeves 130 is a bar 140 from an intermediate portion of which is a downwardly projecting stub 142 and from the outer end of which is another downwardly-projecting strap 144. Secured along the lower end portions of all of stubs 142 is a laterally-extending blade 146. Blade 146 serves as a doctor blade or metering guage of particulate material deposited in front of it. End skirts 147 project forwardly from each end of blade 146. They include lower shoes or riders 148. A corresponding series of bolt assemblies 149 permit selective adjustment of the height above the underlying substrate of the lower edge of blade 146 throughout its length.

Also suspended from bars 140 are a plurality of platens or screeds 150. In this case, each platen has a length corresponding to the width of one lane of the ultimate running track. In itself, each platen 150 is of a hollow box-like configuration and includes an underlying shoe 152. The platen is a container, with fill tubes 151, in which preferably is disposed a liquid such as ordinary antifreeze and which also contains a heating element energizeable through suitable electrical connections. Thermostats 153 maintain constant temperatures of the overall platens.

Each of shoes 152 includes a flat bottom 154 intermediate of its width and embracing upwardly-sloped tapers 155 and 156. Taper 155 prevents the shoe from "digging in"; it also may assist in "ironing out" any deposits ahead of the platen. Taper 156 has a different purpose to be further described. Projecting upwardly from each shoe 152 at the forward side is a shield 157 that assists in avoiding undesired deposits of the material on its following components.

The end of each platen 150 is secured to the next by a hinge 158. On each one of those platens adjacent to the associated hinge is secured a stiff tongue 159 spaced above that platen a distance sufficient to allow for movement to be described. Thus, each tongue 159 is secured to its platen by a spaced mounting at 160.

Projecting upwardly above an end of each platen 150 through a tongue 159 is a stud 170 loaded by a spring 172 and extending through a rocker 174 affixed at the bottom of parallel-spaced strips 176 mounted at their upper ends about a block 178 by a pin 179. Block 178 is secured by a threaded bolt 180 to an intermediate portion of bar 140, so as to complete a suspension of the platen. Moreover, each bolt 180 includes an adjustable nut at 181 for enabling locking of precise adjustment of the ultimate vertical position of the respective one end of the one of the platens below its associated one of bars 140.

At its upper end, each bolt 180 is secured to bar 140 by a coupling 184 that provides freedom of alignment, before it is locked in position. Suitable set screws insure the secure holding of each bolt 180 in its bearing 184 after all is aligned.

Each of platens 150 is pivotally coupled as at 185 to cross rods 186. At each other end 162, the cross rod is pivotally coupled as at 187 to a corresponding point on a channel member 190. Member 190 is a succession of individual elements 192 successively hinged at 194 in correspondence with hinges 158. Platens 150 are thereby permitted to reciprocate back and forth across the width of the track to be laid.

Such reciprocation is induced by a motor 200 belted at 202 to a gear box 203 within which conventional gearing converts rotational movement at ninety degrees delivered by a shaft 204 to a motion translator 205. Translator 205 includes a disc 206 to which shaft 204 is affixed eccentrically. Disc 206 is constrained to slide within an oblong guideway 207 that accommodates vertical movement of the affixed components. Translator 205 is affixed by a plate 208 to the top of its associated one of platens 150.

Thus, all of platens 150 are caused to reciprocate to and fro, in a direction laterally of the track width, simultaneously and in unison. Each of platens 150 is individually hinged at 158 to the next. Yet each platen 150 is independently articulatable during adjustment and also during use. Moreover, the curvature of each of rocker arms 174 is such that the swinging back and forth imparts a horizontally-directed linear reciprocal motion to each of platens 150, as accommodated by hinges 158.

Projecting further to the rear of frame 20 from platens 150 and suspended from that frame is a walkway 220. While not necessary, this can be a convenient appurtenence either for use by a supervisor during operation, for facilitating the adjustment of heights or orientation of the different ones of platens 150 through manipulation of adjustments provided or for applying other material such as an upper surface coloring. As shown, it is connected through a framework to stems 97 and adjustable in elevation by means of cables 102 and 104.

Also illustrated is a bin 222 which contains a blower and is coupled by a duct 224 which leads to a front-end outlet at the front of frame 20. A hose with a nozzle and coupled to the outlet enables the additional application of a fine sand or synthetic rubber particulates (which may be colored) to the previously applied material. After being so applied, the granules desirably are firmly rolled or otherwise pressed into the upper surface of the basic mixture laid.

Spaced along the length of the rearward end of bars 140 are a plurality of turnbuckles 230. Each of turnbuckles 230 connects at its lower end to the associated element 192 of member 190. The outer ends of bars 140 are tied together by straps 232 and 234. Connecting those straps is a member 236 hinged with respect to those respective straps 232 and 234 at either end as at 238.

The upper ends of each of the two central turnbuckles 230 are located and affixed at respective ends of member 236. The others of turnbuckles 230, as shown, are at each outer end of each successive strap 232 and 234. Turnbuckles 230 permit individual angular adjustment of shoes 152 about a horizontal axis.

In operation, deposits of the material to be applied preferably are distributed ahead of the machine and between assemblies 52 and 54. In a more sophisticated embodiment, the machine could also carry bins of such a material and conveyors or other outletting means for automatically distributing the material as the work progressed. Nevertheless, it was found to be highly successful simply to "dump" the material from a vehicle moved ahead of the machine and then only roughly spread it out ahead of blade 146 and forward of wheels 132.

In themselves, the materials are well known for the construction of running tracks. First, a highway-type asphalt base is formed on top of the usual dirt surface that previously has been graded more or less to level or to the slope desired. That asphalt base has been firmly rolled to a consistency as if it were for highway construction. Next, the principal surface material itself need be no more than finely diced prices of styrene butadyne rubber. Suitable rubber particles may be procured from the scrap produced in connection with the retreading of vehicle tires. Such particles typically have sizes measured at about one-sixteenth inch. Before application, they are mixed with a binder in the same manner as in the making of an asphalt mix.

The preferred binder is a polyurethane commercially available from various sources. One well-known such binder specifically marketed for running tracks is produced by the Chevron company and labeled as a "400 Mix Base".

Each of platens 150 is forty-two inches in length, corresponding to the width of a standard running track lane. Thermostats 153 are selected so that the temperature of the platen is approximately 150 degrees Fahrenheit. The heat serves to prevent sticking of the applied material to the shoes on the platens. Reciprocation of platens 150 typically is at a rate of 60 cycles per minute. The length of reciprocal movement in the illustrated apparatus is two inches. The amount of material supplied is sufficient, in a preferred mode of approach, to establish an initial level, upon metering by blade 146, which has a thickness of about five-eighths ($\frac{5}{8}$) inch. The subsequent action of platens 150 then works the material into a finished layer which is about three-eighths ($\frac{3}{8}$) inch in thickness.

In applying the mix, it is preferred to initially coat the underlying asphalt base with the same polymer in a sufficiently diluted form to be highly liquid. That is, it is sprayed on as a primer. It aids in ultimate adherence of the rubber mix to the underlying asphalt.

As indicated in the introduction, one problem with prior approaches was the attempt to lay one lane at a time and achieve joinder between successive lanes. While the machine as illustrated accommodates the simultaneous formation of eight lanes at a time, it is obvious that the number of such lanes to be formed in a single pass is a matter of choice. The embodied machine is capable of operating at a sufficient linear speed, perhaps up to several-hundred-feet per hour, that one can return and install an additional plurality of lanes in less than an hour after the installation of a previous plurality of lanes. If such a second passage is made timely, there can be sealing, bonding and smearing for evenness between the outer margin of the first set of lanes and the inner margin of the next set of lanes.

It is to be noted that the length of booms 40 and 42 is large compared with the distance between the rear ends of those booms and platens 150. As shown, platens 150 are spaced to the rear of wheels 84 and 86 by about eighteen inches. Booms 40 and 42 have a length of about sixteen feet. The result of such a difference in or ratio of distances is that the traverse of track assemblies 52 and 54 across either swales or rises in the substrate does not appreciably effect the desired level of platens 150 and shoes 152 or the directly-related plumb of posts 90 and 92.

The significant function of platens 150 is that of smearing or traveling the deposited material across the total width of the track. This avoids differences in elevation as between one lane and the next. At the same time, the hinging between successive platens enables a consistent application across the substrate which often is not truly level or even across its total width. As finally laid, there are no discernable "lanes". The smearing of the material over and amongst the platen-defined segments produces a bonded layer which exhibits a continuous and even upper surface across the entire width.

Also important are the geometrical relationships of the various components. Blade 146 allows a given amount of the material to be passed toward platens 150. Thereupon, each of platens 150 acts like a workman using a hand trowel. Downward pressure on the platens is not basically involved. It is more a matter of "painting" the material into place smoothly over the underlying substrate. By force of gravity acting on platens 150 and the structures from which they are suspended, shoes 152 remain at whatever elevation is established by the corresponding ones of sensing wheels 132.

In this process, taper 156 is important. As allowed under blade 146, the material is compacted by tunneling or funneling into taper 156 and then under flat bottom 154 of shoe 152. If blade 146 is too high, or if taper 156 is too steep, the material tends to roll up in front of shield 157. Those parameters must be controlled by the described adjustments in order to prohibit fouling of the platen assemblies. At the same time, the same components must be adjusted to insure, at the other extreme, that sufficient material is compacted to achieve the objective of forming a uniform and even upper surface.

As indicated, turnbuckles 230 enable the necessary leveling of shoes 152 after adjusting platen heights by use of nuts 181 and adjusting the height of blade 146 by use of bolt assemblies 149. With posts 90 and 92 maintained plumb, all of the important parameters are retained in a fixed interrelationship which permits ongoing travel of the machine while laying a consistent continuation of the track surface.

The material does not rigidity sufficiently fast to allow any kind of trailing support for the applying apparatus. It is for this reason that platens 150 and blade 146 are cantilevered by bars 140 from sleeves 130. The spacing between wheels 132 and platens 150 should be as small as practical in order that floating wheels 132 are reasonably accurate as a guage to adjust the desired elevations of blade 146 and shoes 152. At the same time, wheels 132, or any substituted detector of the substrate height, must be located so as not to interfere with the distribution of the material ahead of blade 146.

The machine also can be used for other than the formation of running tracks. For example, and in the same environment, it, or a smaller version, can be used to lay the same type of material in front of a high-jump pit.

In illustrating the apparatus, a particular manner of mechanical fabrication has been shown. As mentioned, some of the framework was selected primarily for the reason that it offered performance of the function while yet being conveniently available. Moreover, additional struts, bracing and the like have been shown but not specifically mentioned. These perform clearly-evident strength-giving functions, and they involve such functions as may readily be accomplished by other known approaches.

It appears to be desirable that, as mentioned, the length of each platen 150 corresponds to the assigned width of an ultimate running lane. That assures consistency throughout each individual running lane and enables thickness checks to be made during application at the most important point. It also facilitates modification, addition to or subtraction from the overall width of the machine to accommodate tracks that are to have a different total number of lanes. On the other hand, the smearing of the material is sufficiently effective that such correspondence need not be established. Shorter platens would still enable the formation of a continuous and smooth upper surface. Longer platens also could be used, provided that the underlying asphalt base was much more planar than, in practice, has proved to be the case. In principle, a single platen might be suggested. In the reality of preparing the underlying base, however, lateral unevenness in that base would result in an unacceptable variation in surface resiliency from one point to another. In any event, the "lane" defined may or may not be the same as the ultimate, usually-striped, lane as observed by the runner. Instead, it may be a segment of different width and placement.

While a particular embodiment of the invention has been shown and described, and alternatives have been disclosed, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. the method of laying a running track surface which comprises:

spreading a resilient particulate material over a substrate of a given width but which varies in elevation non-uniformly across that width;

applying pressure individually downwardly on said material over each of a plurality of successive segments of said width that together define a corresponding succession of running lanes, while effecting said pressure applied over each of said segments in an amount which establishes a thickness of said layer that is substantially the same in each of said segments;

and, along with the application of said pressure, smearing said material over and amongst said segments to form a bonded layer of said material which exhibits a continuous upper surface across said width but which also is planar across each individual one of said segments.

2. The method as defined in claim 1 which includes smearing of said material, laterally of said width, individually in and beyond each segment as the pressure is applied thereto.

3. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens with linear motion in a direction laterally across said track to smear said material and form a bonded layer of said material which exhibits a continuous upper surface across said lanes but which also is planar across each individual one of said lanes;

and means coupled to said frame for moving said machine along said track.

4. A machine as defined in claim 3 which includes means for individualizing the elevation of respective different ones of said platens.

5. A machine as defined in claim 4 which further includes means for individually adjusting the angulation of said platens about a horizontal axis.

6. A machine as defined in claim 3 which includes a blade, effectively mounted from said frame, for metering quantities of said material, depositied on the underlying substrate, to said platens.

7. A machine as defined in claim 6 which further includes means for adjusting the elevation of said blade throughout its length.

8. A machine as defined in claim 3 which includes means for sensing the elevation of individual lane corresponding segments of said substrate ahead of said platens and responsively adjusting the individual elevations of said platens.

9. A machine as defined in claim 8 in which said sensing means individually adjusts the elevations or respective different ones of said platens.

10. A machine as defined in claim 3 which further includes a pair of booms projecting forwardly from respective end portions of said frame, and in which said moving means includes steerable traction devices coupled to the ends of said booms remote from said frame.

11. A machine as defined in claim 10 which further includes means for restraining and adjusting the orientation of said booms relative to said frame.

12. A machine as defined in claim 10 which also includes means for tying together the respective ends of said boom remote from said frame.

13. A machine as defined in claim 10 which includes:

means for sensing the elevation of said substrate a predetermined distance ahead of said platens and responsively adjusting the elevation of said platens;

and in which the length of said booms is greater than approximately ten times said predetermined distance.

14. A machine as defined in claim 3 which includes a bin and a blower for delivering and distributing an additional material onto the track surface formed of said material.

15. A machine as defined in claim 3 in which each of said platens includes a first portion merging into an upwardly tapered portion facing forward, the slant of said tapered portion being selected to enable tunneling and resultant compression of said material as said machine is moved forwardly.

16. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

means carried by said frame for sensing the elevation of individual lane-corresponding segments of said substrate ahead of respective ones of said platens and responsively adjusting the individual elevations of corresponding ones of said platens;

and said sensing means further including a corresponding series of wheels that ride freely on said substrate in advance of said platens.

17. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

means carried by said frame for sensing the elevation of individual lane-corresponding segments of said substrate ahead of respective ones of said platens and responsively adjusting the individual elevations of said corresponding platens;

and said platens being cantilevered to the rear from said sensing means.

18. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

means carried by said frame for sensing the elevation of individual lane-corresponding segments of said substrate ahead of respective ones of said platens and responsively adjusting the individual elevations of corresponding ones of said platens;

and a blade carried from said frame for metering said material to said platens and in which said sensing means also adjusts the elevation of said blade.

19. A machine as defined in claim 18 which includes additional means for adjusting the relative horizontal elevations of said platens with respect to said blade.

20. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

a pair of booms projecting forwardly from respective end portions of said frame;

said moving means including steerable traction devices coupled to the ends of said booms remote from said frame;

and means including a universal joint coupling said booms to said frame.

21. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

a pair of booms projecting forwardly from respective end portions of said frame;

said moving means including steerable traction devices coupled to the ends of said booms remote from said frame;

and means secured between said booms and said frame for adjusting the angulation of said platens about a horizontal axis.

22. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens depending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

a pair of booms projecting forwardly from repective end portions of said frame;

said moving means including steerable traction devices coupled to the ends of said booms remote from said frame;

pedestals supporting the respective ends of said booms adjacent to said frame;

respective wheels coupled to the lower ends of said pedestals;

and means for adjusting the effective height of said pedestals above said wheels.

23. A machine for laying a resilient track surface material on a substrate which varies in elevation non-uniformly across its width, comprising:

an elongated frame of a length sufficient to span a plurality of successive lanes of a running track;

a plurality of successively-hinged individually-articulatable platens defpending from and distributed along said frame, each platen having a length corresponding to the width of a respective one of said lanes;

means included individually with respect to each of said platens for enabling the application of pressure on said material toward the underlying substrate of said track, while effecting said pressure applied over each of said lanes in an amount which establishes a thickness of said layer that is substantially the same in each of said lanes;

means coupled to said frame for reciprocating said platens laterally to smear said material and form a bonded layer of said material which exhibits a continuous uppersurface across said lanes but which also is planar across each individual one of said lanes;

means coupled to said frame for moving said machine along said track;

said reciprocating means including a series of elements spaced above said platen and driven in reciprocation back and forth across the width of said track;

and means for suspending said platens from said elements and allowing said platens to rock back and forth in reciprocation while retaining linear movement.

* * * * *